US005934348A

United States Patent [19]

Dietz

[11] Patent Number: 5,934,348

[45] Date of Patent: Aug. 10, 1999

[54] METHOD AND APPARATUS FOR THE FABRICATION OF STRANDS

[76] Inventor: Hans Dietz, Sperberweg 5, D-72119, Ammerbuch, Germany

[21] Appl. No.: 08/908,823

[22] Filed: Aug. 8, 1997

Related U.S. Application Data

[63] Continuation-in-part of application No. PCT/EP96/00433, Feb. 8, 1995.

[51] Int. Cl.[6] ..... B27B 1/00; B27L 5/02

[52] U.S. Cl. ..... 144/357; 144/3.1; 144/39; 144/329; 144/366; 144/367; 144/369; 144/373

[58] Field of Search ..... 144/3.1, 37, 39, 144/41, 329, 356, 357, 359, 367, 368, 369, 373, 374, 375, 366

[56] References Cited

U.S. PATENT DOCUMENTS

| | | | |
|---|---|---|---|
| 3,487,866 | 1/1970 | Mitten | 144/41 |
| 3,650,307 | 3/1972 | Johnson | 144/2.1 |
| 3,934,630 | 1/1976 | Cockle | 144/3.1 |
| 4,149,577 | 4/1979 | Matusewicz et al. | 144/39 |
| 4,300,604 | 11/1981 | Zimmerman | 144/41 |
| 4,301,844 | 11/1981 | Tannerstal | 144/3.1 |
| 4,327,789 | 5/1982 | Reuter | 144/39 |
| 4,371,020 | 2/1983 | Barnes | 144/366 |
| 4,421,149 | 12/1983 | Barnes et al. | 144/366 |
| 4,570,687 | 2/1986 | Dietz | 144/41 |
| 4,599,929 | 7/1986 | Dutina | 144/39 |
| 4,681,146 | 7/1987 | Liska et al. | 144/3.1 |
| 4,846,237 | 7/1989 | Wolf | 144/3.1 |
| 5,143,127 | 9/1992 | Rautio | 144/41 |

FOREIGN PATENT DOCUMENTS

| | | | |
|---|---|---|---|
| 1503969 | 9/1960 | Germany . | |
| 3114843 C2 | 4/1981 | Germany | B27B 1/00 |
| 3837200 C1 | 11/1988 | Germany | B27L 11/100 |
| 871987 | 7/1961 | United Kingdom . | |

*Primary Examiner*—W. Donald Bray
*Attorney, Agent, or Firm*—Claude A. S. Hamrick; Oppenheimer W. Donnelly

[57] ABSTRACT

A method and an apparatus for fabricating strands from round wood are disclosed. The strands have a length of between 200 and 350 mm in the direction of the wood fibers and have a width of between 1 and 15 mm. The strands are fabricated from profiled logs. In the cross-section of the logs, residual areas outside a center piece are defined, the center piece being the area intended to be dissected into beams or boards at a later stage. The residual areas are provided with longitudinal slits by cutting or sawing. The strands are then cut out of the residual areas until the residual areas are entirely removed.

20 Claims, 5 Drawing Sheets

METHOD AND APPARATUS FOR THE FABRICATION OF STRANDS

The present invention is a continuation-in-part of International Application No. PCT/EP96/00433 filed Feb. 8, 1995 entitled "METHOD AND APPARATUS FOR THE FABRICATION OF STRANDS", by Hans Dietz, sole inventor and owner of the present application.

FIELD OF THE INVENTION

The invention relates to a method for the fabrication of strands from round wood, wherein the strands in the fiber direction exhibit a length of between 200 and 350 mm as well as a width and a thickness of between 1 and 15 mm transverse to the fiber direction.

The invention, further, relates to an apparatus for the fabrication of strands from round wood comprising a conveyor for the round wood and at least one chipping device for cutting strands, wherein the strands in the fiber direction exhibit a length of between 200 and 350 mm as well as a width and a thickness of between 1 and 15 mm.

A method and an apparatus of the afore-mentioned kind is known, for example from DE 38 37 200 C1.

BACKGROUND OF THE INVENTION

It is well known to manufacture wood products such as beams or boards out of chips instead out of massive wood. Apart from the known chip-boards, there exist similar types of products made out of so-called "strands" also known in the art as "wafers" or "flakes". These terms as a whole shall mean wood chips having relatively large dimensions, as compared with wood chips which are, for example, produced during the chipping of lateral areas of logs, of barked sections or the like. Typically, a strand has a length of between 200 and 350 mm in the fiber direction, and a width and a thickness in a direction transverse to the fiber direction of between 1 and 15 mm. Wood products such as boards or beams manufactured from such strands by combining and glueing them together are known as "composite beams", "strand boards" or "structural lumber products".

For this purpose, it is also known how to fashion strands with defined width, length and thickness and in certain circumstances with defined chamfered edges so that the strands may be glued in a definite alignment to form planks and beams.

DE 38 37 200 C1 mentioned at the outset discloses a wood chipping machine for the fabrication of such flat chips or strands. This prior art machine is intended to produce large area flat chips having a predetermined thickness, width and length. For that purpose round woods are fed to a chipping drum in a direction perpendicular to their longitudinal extension. The chipping drum comprises an outer cutting rotor together with an inner hammer rotor arranged concentrically thereto. The two rotors are driven in opposite directions of rotation. The cutting rotor cuts chips from the broad side of the round woods which then reach the interior of the drum for being cut into the required flat chips of predetermined dimensions by means of the hammer rotor. The strands thus generated are deflected out of the interior of the chipping drum by means of a baffle and are guided onto a conveyor belt.

In this prior art machine the diameter of the chipping drum is about 60 cm. The prior art machine handles relatively small round woods having a diameter of about 15 cm, i.e. handles trimmed branch pieces and the like. The round wood is thereby entirely chipped.

A method for the fabrication of long strands is disclosed in U.S. Pat. No. 4,371,020 and U.S. Pat. No. 421,149. According to this prior art method a round wood is first shifted through a knife arrangement in an axial direction, the knife arrangement having four knives located along diameters of the round wood and being offset with respect to one another by 45°. The round wood is guided axially through this knife arrangement so that the round wood, when having passed the knife arrangement, is dissected into a total of eight segments being sector-shaped in a radial cross sectional view. These segments are then guided through a spaced arrangement of stationary knives so that strands are generated which are axially parallel. These strands, however, have different widths in a radial direction. They are, subsequently, guided through a cutting roller arrangement in which they are dissected into elongate thin strands having a square cross section.

According to this prior art method the round woods are also completely chipped.

A method and an apparatus for the fabrication of strands is disclosed in U.S. Pat. No. 4,681,146. The strands are also fabricated from the round wood already mentioned in that they are fed in a feed station on a slicer-type table with their broad side upfront. By means of an oscillating slicing plate the round woods are chipped into flat chips. The flat chips are then further dissected by means of knife rollers.

Also according to this prior art method the round wood is entirely chipped.

DE 31 14 843 A1 discloses a so-called "profiling method". During the carrying out of a profiling method the entire logs are firstly profiled, i.e. they are machined in an axial direction by means of corner millers and profile chippers. The result of such working is a so-called model. This term is to be understood to mean a wood product having a radial cross sectional shape being configured for the subsequent dissection of the model into planks and beams for an optimum yield of the wood.

According to conventional profiling methods the areas being chipped off or chipped away by means of profile chippers or corner millers are converted into short chips as are conventionally used for producing cellulose or chipboards.

U.S. Pat. No. 4,149,577 discloses an apparatus enabling to concurrently generate a plurality of elongate slits in a log by means of saw blades.

It is, therefore, an object underlying the invention to improve a method as mentioned at the outset so that the fabrication of strands becomes also possible outside a field of application where only relatively small round woods (branch pieces) are entirely chipped.

SUMMARY OF THE INVENTION

Accordingly to the method specified at the outset this object is met by the following steps:

providing a log having a longitudinal axis;

in a radial cross-section of the log determining a log center piece, the center piece being intended to be dissected into beams or boards at a later stage after the carrying out of the method and residual areas outside the center piece;

providing longitudinal slits along the residual areas, the slits being spaced one from the other by the width (b) and extending along the fiber direction; and cutting the strands out of the residual areas.

The object is, further, met by the following features:

means for providing a log, the log having a longitudinal axis;

means for determining in a radial cross-section of the log:

a log center piece, the center piece being intended to be dissected into beams or boards at a later stage after the carrying out of the method and residual areas outside the center piece;

means for providing longitudinal slits along the residual areas, the slits being spaced one from the other by the width (b) and extending along said fiber direction; and means for cutting said strands out of the residual areas.

The object underlying the invention is thus entirely solved.

For, the invention represents a clear departure from prior art methods for the fabrication of strands. These methods were restricted to such primary materials, namely round wood, which were entirely chipped during the fabrication of strands. Therefore, only relatively small round woods could be taken into account as primary materials, i.e. trimmed branches, thicker twigs and possibly even trunks of very young trees.

In contrast, the invention broadens the field of application of methods for the fabrication of strands and corresponding apparatuses to such wood working methods during which the massive wood of large round woods, namely from logs, are only partially chipped, while the rest of the logs is shaped into massive wood products. Such wood working processes are of great commercial importance and are finding widespread application.

Whereas with the working of logs in conventional processes and apparatuses, in each case only chips or sawdust were produced, it has become possible with the present invention to produce valuable chips, namely strands.

This has significant implications for the operators of wood working plants, because the marketing of by-products from wood working is of increasing economic importance. This means that the fabrication of strands will also be possible with those plants which previously worked whole logs associated with the generation of comminuted wood such as chips as by-product. To achieve this only minor alterations or supplementations to the existing plants are necessary. The economic viability of such plants can be significantly improved with little cost.

In a first embodiment of the method mentioned above, the strands are cut in a single working step between the longitudinal slits with a length along transverse slits simultaneously produced, and with the thickness. The same holds true for an embodiment of the inventive apparatus according to which the chipping device is provided with chippers arranged downstream the first tools, the chippers cutting the strands between the longitudinal slits in a single cutting step to lengths along transverse slits cut simultaneously, and with the thickness.

According to a second alternative of this embodiment of an inventive method, the residual areas, after the provision of the longitudinal slits, in a first step are provided with transverse slits being spaced one from the other by the length, and, in a second step the strands are cut to the thickness. The same holds true for a corresponding embodiment of the inventive apparatus in which the chipping device is provided with second tools for generating transverse slits in the residual areas, the transverse slits being spaced one from the other by the length, third tools being also provided in the direction of transport downstream from the first and the second tools for cutting the strands to the thickness.

These features mentioned before have the advantage that it is possible to fabricate strands with dimensions varying in wide ranges according to two alternate approaches, wherein the dimensions may be exactly predetermined with respect to length, width and thickness. By shaping the tools accordingly, it is, further, possible to fabricate chamfered or otherwise profiled strands.

According to another embodiment of the inventive method, it is preferred that the strands are slit firstly on two opposite sides of the log and then on both opposite sides of the log peripherally offset by 90° thereto.

This measure has the advantage that sequences of working steps may be used as are known per se from prior art profiling methods. It is, for example, possible to use two working stations arranged one after the other in the direction of transport and to rotate the log by 90° about its longitudinal axis after it has already been partially worked. As an alternative, it is possible to use only one such working station, to rotate the log by 90° after it has left the first working station and to then feed the rotated log back to the input of the working station by means of a feedback conveyor.

According to preferred embodiments of the inventive method the longitudinal slits are generated as longitudinal cuts by means of knives. As an alternative, the longitudinal slits may also be generated by means of saws.

It is likewise possible to generate the transverse slits as transverse cuts by cutting same or by using saws.

According to embodiments of the inventive apparatus the first tools are, therefore, alternately configured as first knives or as first saws, whereas the second tools are configured as second knives or, alternately, as second saws.

BRIEF DESCRIPTION OF THE DRAWINGS

An embodiment of the invention is shown in the drawing and will be further explained in the subsequent description.

DETAILED DESCRIPTION OF THE PREFERRED EMBODIMENTS

Figure 1:
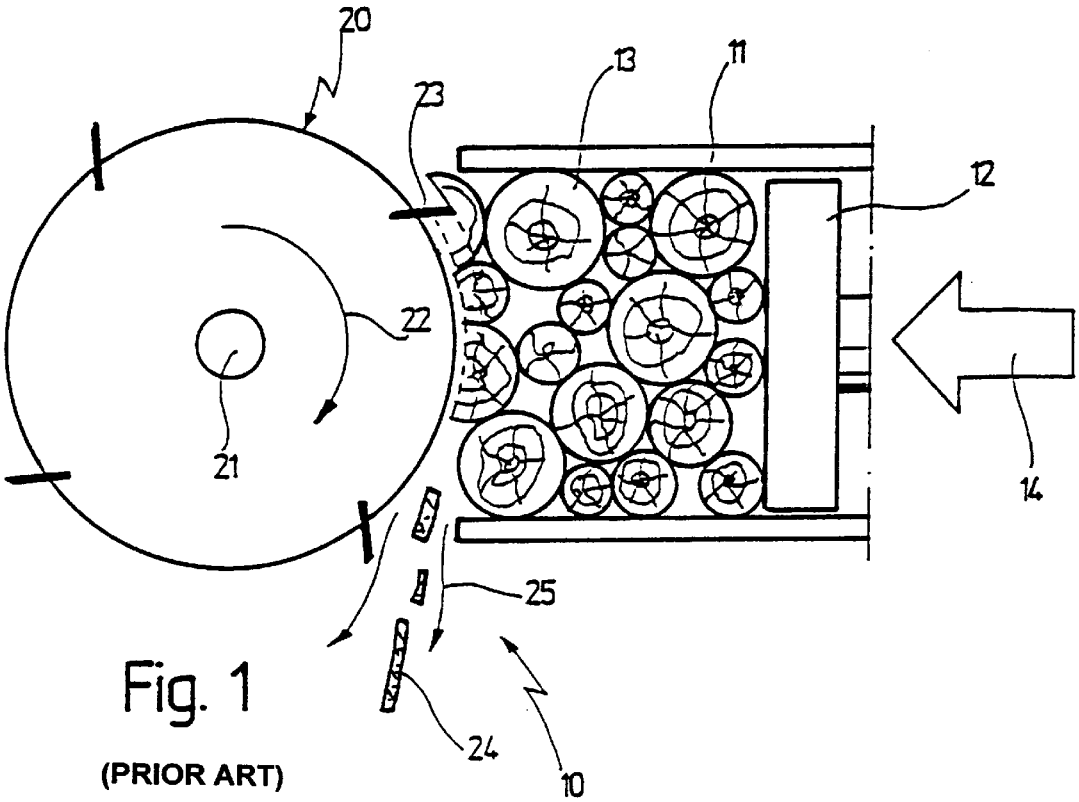
Fig. 1 (PRIOR ART)
FIG. 1 is a side elevational view of an extremely simplified apparatus for the fabrication of strands according to the prior art.

In FIG. 1 reference numeral 10 indicates a conventional apparatus for the production of strands. By means of a feed guide 11, in which a ram 12 reciprocates, round wood 13 is forced through the guide 11 in the direction of an arrow 14. The round woods are fed in a direction perpendicular to their longitudinal axis.

A rotating cylindrical chipper 20 is situated directly at the exit of feed guide 11. A drive shaft 21 rotates chipper 20 in the direction of rotation as indicated by an arrow 22. The periphery of chipper 20 is provided with knives or blades 23 protruding from the periphery of chipper 20. Round woods 13 being fed from a lateral direction come, hence, in the area of engagement of rotating blades 23 as indicated in FIG. 1 by dashed lines.

By doing so single flat chips or strands 24 are chipped or cut from round woods 13 and are ejected from apparatus 10 in the direction of arrows 25.

The illustration of FIG. 1 is extremely schematic. It goes without saying that the strands 24 shown may be subsequently worked on in further work stations. For example, they may be further subdivided, may be profiled at their edges etc., as is known per se from the prior art discussed at the outset.

Figure 2:
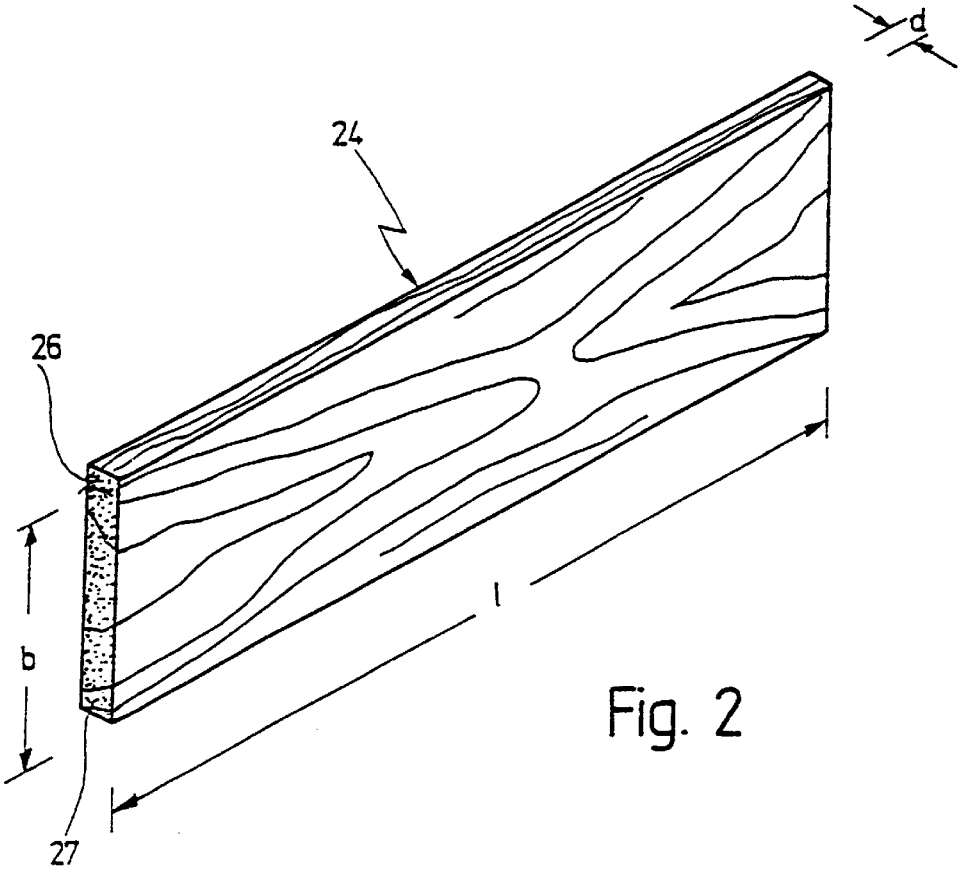
FIG. 2 shows a perspective view of one single strand on a highly enlarged scale.

For illustrating the distinctions as compared with conventional chopped chips or other chips, FIG. 2 shows a strand 24 on an enlarged scale. A front 26 of chip 24 clearly shows fibers 27 of the wood. The length l of strands 24 in the fiber direction is essentially larger as compared with the width b or with the thickness d, each in a direction transverse to the fiber direction.

In practice strands have a length l of between 100 and 350 mm, have a width b of between 1 and 15 mm and, finally, have a thickness d of between 1 and 6 mm. However, deviations from these values are possible.

Other than shown in FIG. 2 strands 24 may also have a non-square shape, for example may have a prismatic or other shape. This allows to fit single strands 24 together in a predetermined alignment and position for glueing them together as composite beams or composite boards, so-called "strand boards".

Figure 3:
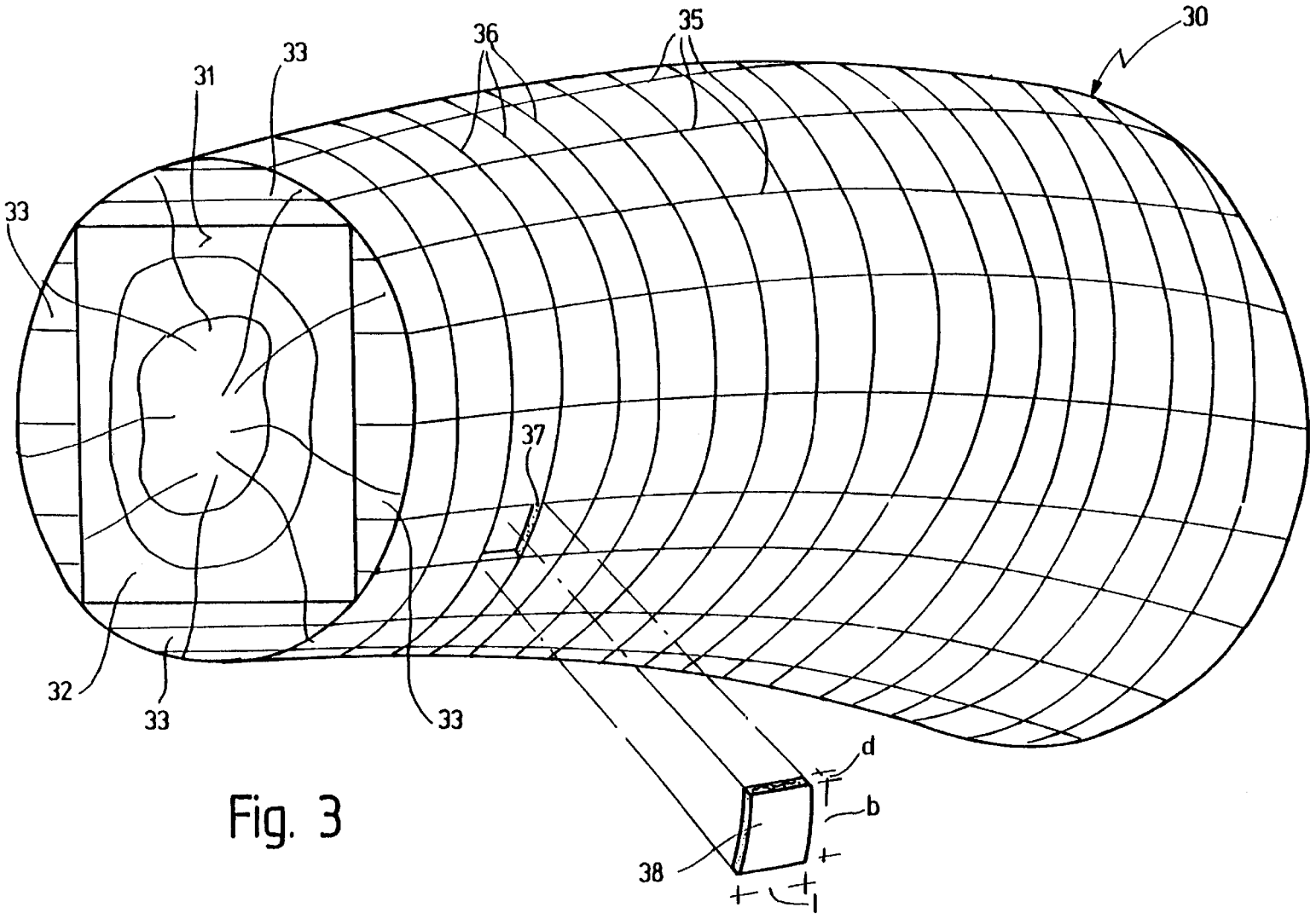
FIG. 3 is a perspective side elevational view of a log to be processed.

FIG. 3 also in very schematic illustration shows a round wood 30, i.e. an entire wood trunk or log. A center piece or main body 32 is outlined on a front side 31 at the thinner end of log 30. This term is to be understood to mean an area having a rectangular or square cross-sectional area within the center of log 30. The respective area corresponds to that area of the log 30 from which the afore-mentioned center piece 32 shall be generated, i.e. beams, planks or the like.

In conventional profiling processes the remaining residual areas 33 are partly processed for fabricating side boards and are, partially, chipped away by generating chopped chips or by sawing.

It is a particular feature of the present process that the illustrated residual areas 33 are entirely or partly transformed into strands 38.

For that purpose residual areas 33 are provided with longitudinal cuts 35 and transverse cuts 36 so that strands 38 may be cut in layers 37. When doing so, strands 38 are fabricated having a predetermined length l, width b and thickness d.

If, in the scope of the present invention the term "cuts" is used, i.e. for example when longitudinal cuts 35 and transverse cuts 36 are mentioned, this shall be understood only as an example. Generally speaking, the logs are provided with slits and the slits may be applied either by means of knives or blades in the form of cuts or may be applied by means of saws.

Figure 4:
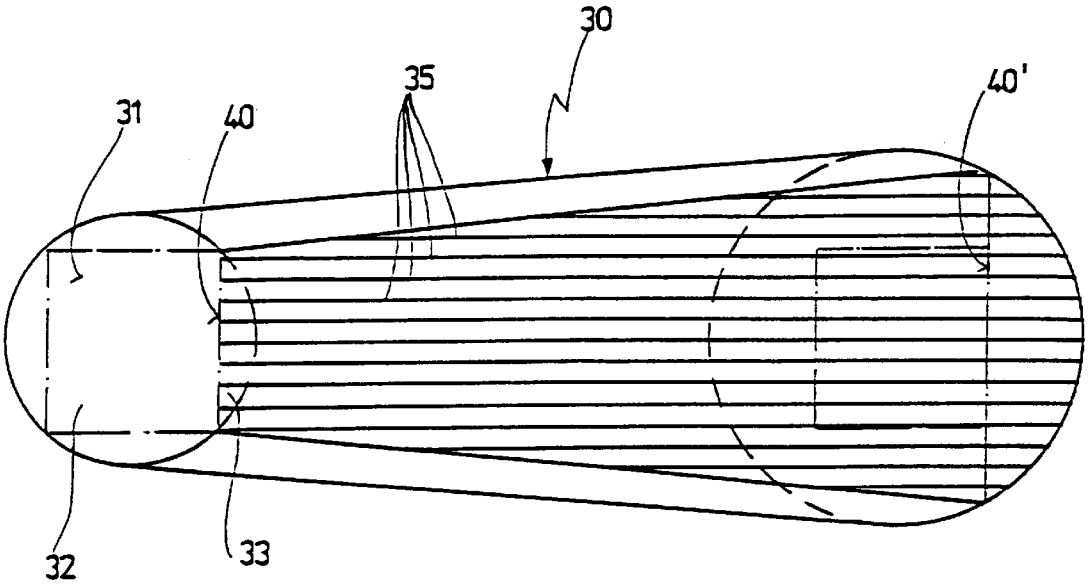
FIGS. 4 and 5 are two schematic side elevational views, similar to that of FIG. 3, for explaining subsequent working steps according to an embodiment of the method.
Figure 5:
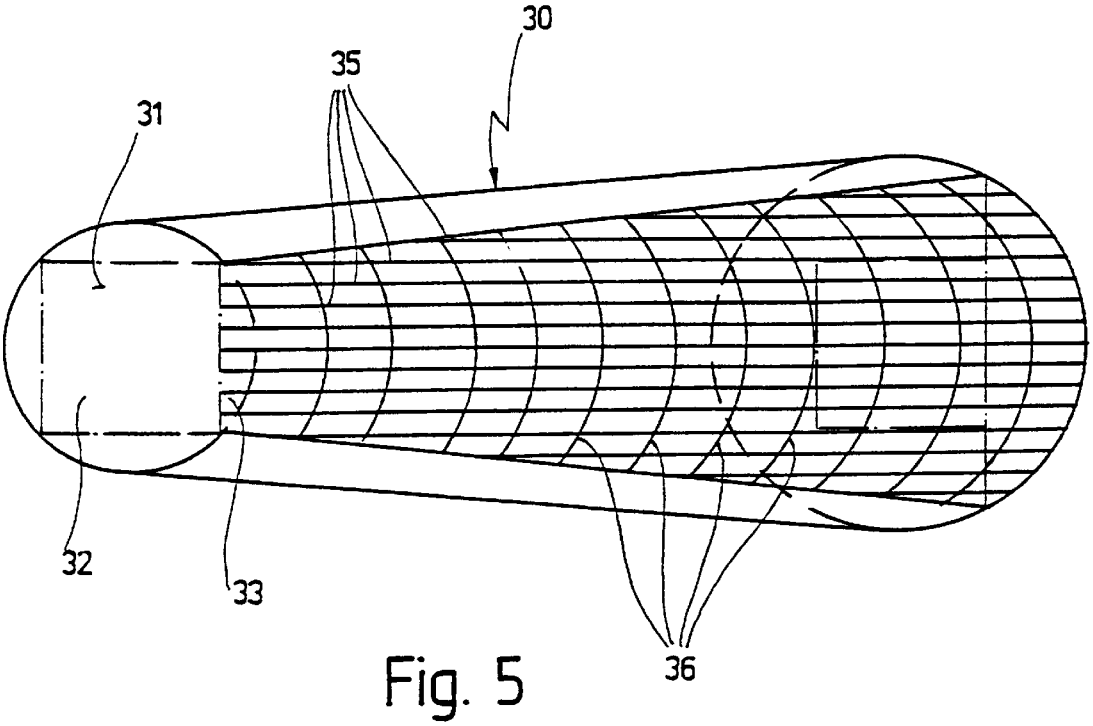
Figure 10:
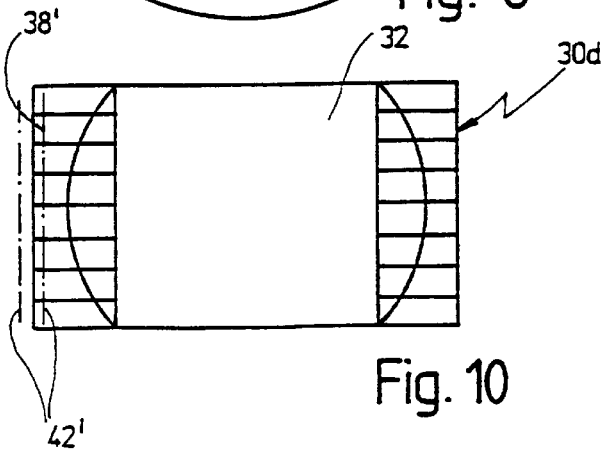
Figure 11:
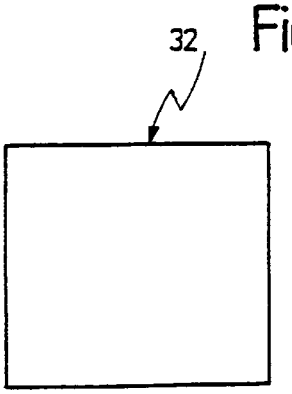
Figure 12:
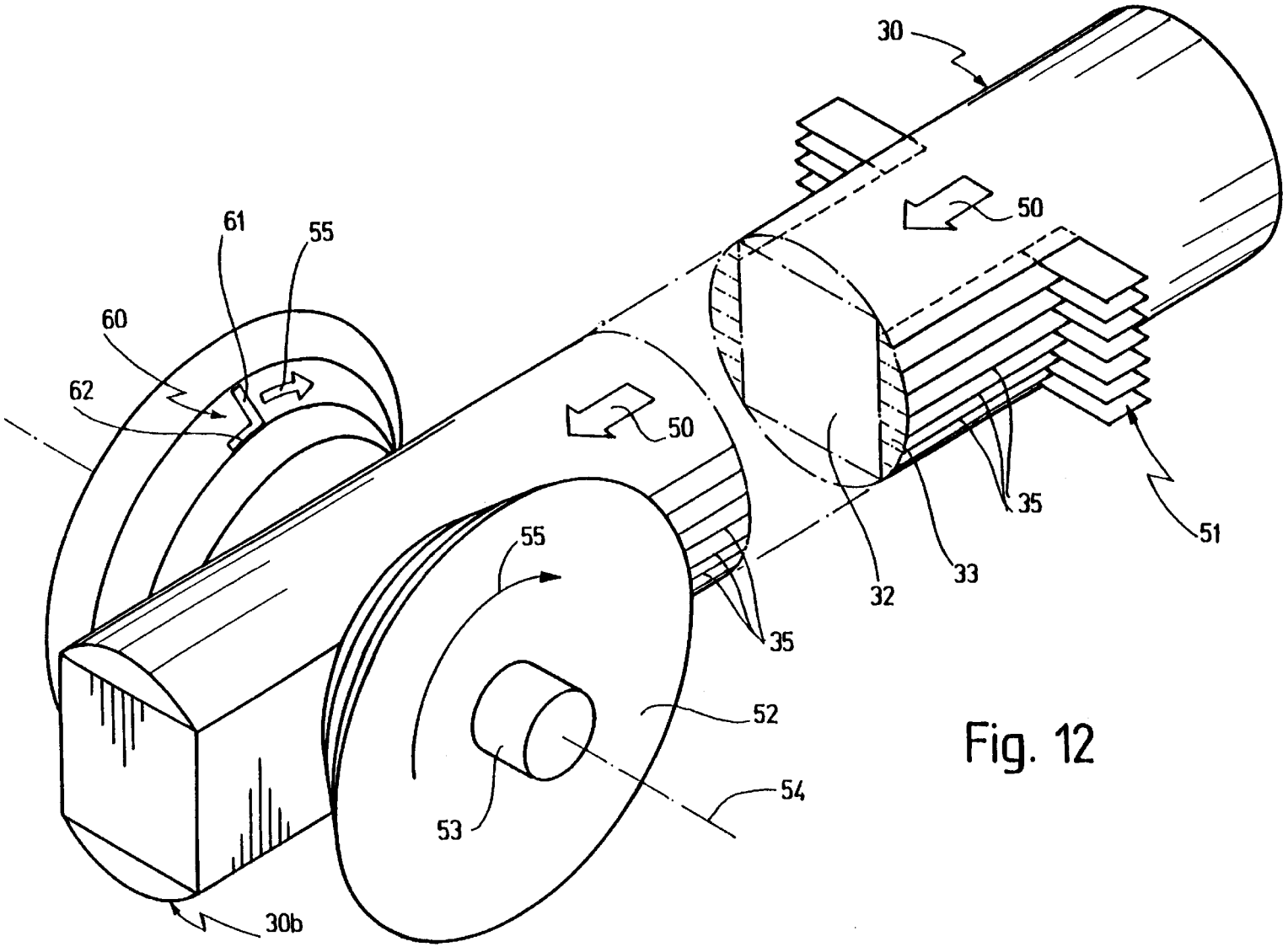
FIG. 12 is a perspective side elevational view of an embodiment of an apparatus.

Details of the applied process and of the apparatus as used in connection therewith shall be explained hereafter together with FIGS. 4 through 12. FIGS. 4 and 5 show two highly schematic perspective side elevational views of log 30 whereas FIGS. 6 through 11 show radial cross-sectional views of log 30 during subsequent processing steps. FIG. 12, finally, shows a perspective illustration of the particular apparatus used.

Figure 6:
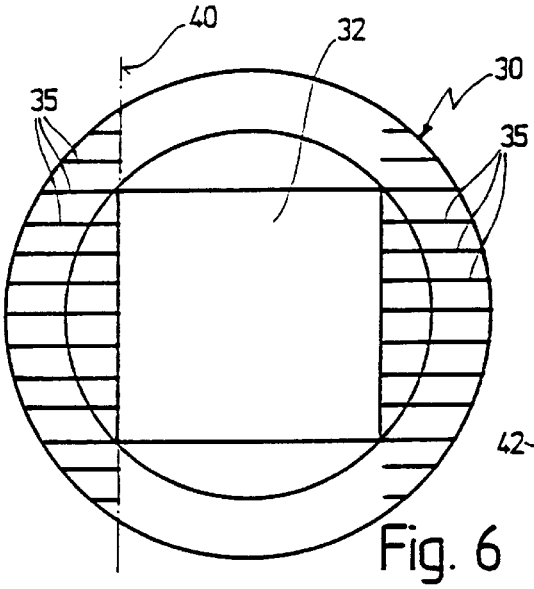
FIGS. 6–11 are radial cross sectional view of logs according to the depiction of FIGS. 4 and 5 for explaining subsequent working steps.

For processing log 30, longitudinal cuts 35 are firstly applied as shown in FIGS. 4 and 6. For that purpose log 30 is guided through two groups of stationary knives or blades 51 in an axial direction by means of conveyors 50 indicated only schematically as arrows. Knives 51 generate longitudinal cuts 35 in log 30 down to a terminal line 40 being also the side edge of center piece 32. As can clearly be seen from FIGS. 6 and 12, longitudinal cuts 35 may, for example, be simultaneously applied onto opposite sides of log 30.

In view of the explanation above, blades 51 shall be understood only as an example. Instead of using blades 51 for applying cuts, one can, of course, also use saws for applying corresponding slits.

For processing log 30 further, one now has two alternatives.

According to a first alternative transverse slits 36 are applied to log 30 in a separate process step, as shown in FIG. 5. For that purpose one may use an appropriate group of cutting knives (not shown) being guided perpendicular to the longitudinal direction of log 30 down to the depth of terminal line 40. Log 30 would then be configured as shown in FIG. 3.

For cutting strands 38 one might let log 30 run against a stepped group of stationary knives extending in the direction of transport, i.e. in the longitudinal direction of log 30. These knives would cut strands 38 in a predetermined length l, width b and thickness. An apparatus of this kind is, for example, disclosed in U.S. Pat. No. 4,371,020 discussed above.

According to a second alternative, being particularly preferred in the present context, transverse cuts 36 are applied in the same process step that also cuts strands 38. For that purpose one uses chippers 52 shown as an example in FIG. 12. Chippers 52 are driven by means of shafts 53. Shafts 53 extend along axes 54 perpendicular to the longitudinal direction of log 30. In the illustrated embodiment chippers 52 are rotated in the direction of arrows 55. Chippers 52 are provided with conical working surfaces. The conical working surfaces have plural threads provided with knives 60 or blades having each a primary cutting edge 61 as well as a secondary cutting edge 62. Primary cutting edge 61 and secondary cutting edge 62 may be configured as two separate blades distributed over the periphery. By doing so, the illustrated embodiment allows to chip the respective residual areas 33 adjoining the center piece 32 on both sides of log 30.

Figure 7:
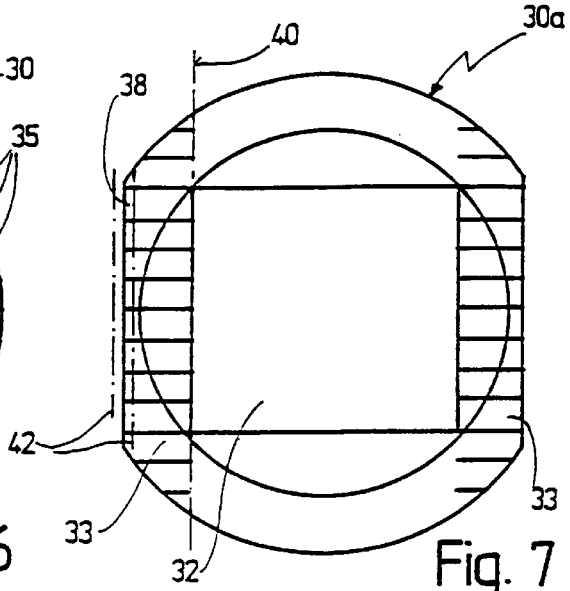

Due to the conicity of the surfaces, chipper 52 cuts away residual areas 33 in layers, as indicated in FIG. 7 by dash-dot sectional lines 42. By configuring and positioning primary cutting edge 61 and secondary cutting edge 62 accordingly, it is possible to thereby cut strands 38 having a predetermined length l and thickness d. FIG. 7 shows the state in which the two residual areas 33 have been chipped away as strands 38 by about one third. This state of log 30 is indicated by reference numeral 30*a* in FIG. 7.

Figure 8:
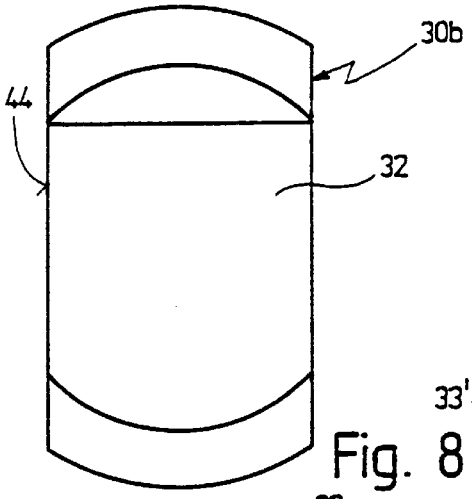

FIG. 8 shows the state 30*b* of log 30 in which the two mentioned residual areas 33 have been entirely removed. One side 44 of center piece 32 is, thus, finally configured.

Figure 9:
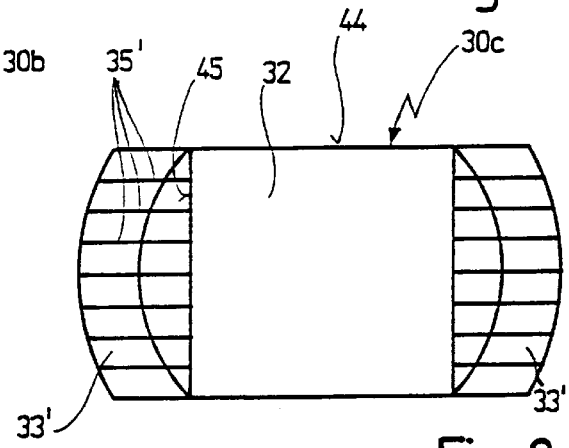

Log 30 is now rotated by 90° about its longitudinal axis and comes in the position shown in FIG. 9. In this position log 30 is again provided with longitudinal cuts 35 in the remaining residual areas 33' being now located laterally, again by means of the apparatus of FIG. 12 (state 30*c*). For that purpose the apparatus of FIG. 12 may be provided two time along the direction of transport of logs 30. Between these two apparatuses log 30 may be rotated by 90° or the two single apparatuses may be rotated with respect to each other by 90°. Further, it is also possible to rotate log 30 after having left the apparatus of FIG. 12 and to feed it back to the input of the apparatus of FIG. 12 by means of a return conveyor.

Log 30 having been processed in this way is now again chipped away on its longitudinally cut residual areas 33', as illustrated in FIG. 10 as state 30*d*. One may again see sectional lines 42' and cut strands 38'. At the end of the working step being partially completed according to FIG. 10, center piece 32 is entirely worked, as is shown in FIG. 11.

According to the process explained above, residual areas 33, 33' are entirely converted into strands 38, 38'. It goes, however, without saying that one may also remove residual areas 33, 33' only partially, for example if it is intended to process portions of residual areas 33, 33', for example, as boards. In that case the respective depths of engagement (terminal lines 40) must be set accordingly.

I claim:

1. A method for the fabrication of strands from a generally cylindrical wood log, said strands having a wood fiber direction and a length (l) of between 200 mm and 350 mm in said fiber direction as well as a width (b) of between 1 mm and 15 mm in a direction transverse to said fiber direction, and a predetermined thickness (d), the method comprising the steps of:

providing a wood log having a longitudinal axis;

determining in said log, a log center portion extending along the longitudinal axis thereof and intended to be longitudinally dissected into beams or boards, and residual log portions outside said center portion;

providing longitudinal slits along said residual portions, said slits being spaced apart by said width (b) and extending along said fiber direction; and cutting said strands out of said residual portions.

2. The method of claim 1, wherein the step of cutting comprises:

providing transverse slits to said residual portions, said transverse slits being spaced one from the other by said length (l) and, simultaneously, chipping said strands out of said residual portions with said predetermined thickness (d).

3. The method of claim 1, wherein the step of cutting comprises the sub-steps of:

providing transverse slits to said residual portions, said transverse slits being spaced one from the other by said length (l), and thereafter chipping said strands from said residual areas with said predetermined thickness (d).

4. The method of claim 1, wherein the step of providing longitudinal slits comprises the sub-steps of:

providing said longitudinal slits on a first pair of opposite sides of said log;

rotating said log by 90° about said longitudinal axis; and providing said longitudinal slits on a second pair of opposite sides of said log, said second pair of opposite sides being peripherally offset from said first pair of opposite sides by 90°.

5. The method of claim 1, wherein said longitudinal slits are provided by means of cutting blades.

6. The method of claim 1, wherein said longitudinal slits are provides by means of saw blades.

7. The method of claim 3, wherein said transverse slits are provided by means of cutting blades.

8. The method of claim 3, wherein said transverse slits are provided by means of saw blades.

9. An apparatus for the fabrication of strands from a generally cylindrical wood log, said strands having a wood fiber direction and exhibiting a length (l) of between 200 mm and 350 mm in said fiber direction as well as a width (b) of between 1 mm and 15 mm in a direction transverse to said fiber direction, and a predetermined thickness (d), the apparatus comprising:

means for supporting a log having a longitudinal axis;

means for determining, a log center portion extending along said longitudinal axis and intended to be longitudinally dissected into beams or boards, and residual log portions outside said center portion;

means for providing longitudinal slits along said residual portions, said slits being spaced one from the other by said width (b) and extending along said fiber direction; and means for cutting said strands out of said residual portions.

10. The apparatus of claim 9, comprising means for conveying said logs in a direction parallel to said axis, said means for cutting including chipping means arranged along said conveying direction downstream from said means for providing longitudinal slits, said chipping means cutting said strands out of said residual portions in a single cutting step.

11. The apparatus of claim 9, further comprising means for conveying said logs in a direction parallel to said axis, said means for cutting being arranged along said conveying direction downstream from said means for providing longitudinal slits and including:

means for providing transverse slits to said residual portions, said transverse slits being spaced one from the other by said length (l), and chipping means for cutting said strands out of said residual portions and being arranged downstream from said means for providing transverse slits.

12. The apparatus of claim 9, wherein said means for providing longitudinal slits are configured as cutting blades.

13. The method of claim 9, wherein said means for providing longitudinal slits are configured as saw blades.

14. The method of claim 11, wherein said means for providing transverse slits are configured as cutting blades.

15. The method of claim 11, wherein said means for providing transverse slits are configured as saw blades.

16. A method for fabricating strands of wood from a generally cylindrical wood log, said strands having a wood fiber direction and having a strand length extending between 200 mm and 350 mm in said wood fiber direction, a strand width extending between 1 mm and 15 mm in a direction transverse to said fiber direction, and a predetermined strand thickness, the method comprising the steps of:

providing a log having a longitudinal axis;

determining a center portion of said log, said center portion extending along the length of said log and being intended for longitudinal dissection into beams or boards;

determining residual portions of said log which are disposed outside of said center portion;

forming a plurality of longitudinal slits in said residual portions, each of said longitudinal slits extending along said fiber direction and being spaced apart from an adjacent one of said longitudinal slits by said strand width; and cutting said strands out of said residual portions.

17. A method for fabricating strands of wood as recited in claim 16 wherein said step of cutting comprises:

forming a plurality of transverse slits in said residual portions, each of said transverse slits being spaced apart from adjacent transverse slits by said strand length; and chipping said strands out of said residual portions.

18. A method for fabricating strands of wood as recited in claim 17 wherein said step of forming said plurality of longitudinal slits comprises:

forming a first set of said plurality of longitudinal slits on a first pair of opposite sides of said log;

rotating said log by 90 degrees about said longitudinal axis; and forming a second set of said plurality of longitudinal slits on a second pair of opposite sides of said log, said second pair of opposite sides being offset from said first pair of opposite sides by 90 degrees.

19. A method for fabricating strands of wood as recited in claim 16 wherein said longitudinal slits are formed by means selected from the group consisting of cutting blades and saw blades.

20. A method for fabricating strands of wood as recited in claim 17 wherein said transverse slits are formed by means selected from the group consisting of cutting blades and saw blades.

* * * * *